United States Patent [19]

Mulroy

[11] 4,114,795

[45] Sep. 19, 1978

[54] CORNER LOCK BULK BIN

[75] Inventor: Terence J. Mulroy, Sioux City, Iowa

[73] Assignee: Champion International Corporation, Stamford, Conn.

[21] Appl. No.: 858,109

[22] Filed: Dec. 7, 1977

[51] Int. Cl.[2] ..... B65D 13/04; B65D 5/12

[52] U.S. Cl. ..... 229/23 R; 229/39 R

[58] Field of Search ..... 229/23 R, 39 R, 41 C, 229/35

[56] References Cited

U.S. PATENT DOCUMENTS

| | | | |
|---|---|---|---|
| 241,409 | 5/1881 | Osborn | 229/39 R |
| 2,388,288 | 11/1945 | Ringler et al. | 229/39 R X |
| 2,565,188 | 8/1951 | Welshembach | 229/39 R X |
| 2,726,803 | 12/1955 | Ketler | 229/23 R X |
| 2,844,296 | 7/1958 | Soja | 229/39 R |
| 3,018,029 | 1/1962 | Fellowes | 229/39 R |
| 3,487,990 | 1/1970 | Overton et al. | 229/23 R |
| 3,527,399 | 9/1970 | Layne, Sr. | 229/39 R |
| 3,945,558 | 3/1976 | Elder | 229/41 C X |

*Primary Examiner*—Davis T. Moorhead
*Attorney, Agent, or Firm*—Evelyn M. Sommer

[57] ABSTRACT

An octagonal-shaped paperboard bulk bin particularly suited for use with heavy, palletized loads of meat products and the like is formed of alternating, upstanding side panels and corner panels. Each corner panel includes a foldably connected, horizontally disposed rectangular flap which is initially folded inwardly such that each flap is in overlapping relationship to the interior of the bin. An octagonal sheet having slots at opposite corners receives a portion of each corner panel therethrough to provide a bottom for the bin and to rigidify the bin construction during assembly and use.

5 Claims, 4 Drawing Figures

CORNER LOCK BULK BIN

BACKGROUND OF THE INVENTION

1. Field of the Invention

The subject invention relates to a new and improved paperboard bulk bin, and more particularly to a rigidified paperboard bulk bin of octagon shape.

2. Description of the Prior Art

The subject invention is particularly concerned with a bin for relatively heavy, palletized loads, for example, large quantities of fresh meat, which are to be moved from place to place. In a centralized meat cutting operation involving the mechanized cutting, packaging, and shipment of large quantities of fresh meat, heavy duty bulk bins are required, and preferably heavy duty bulk bins that can be easily erected by a workman in a minimum amount of time. The resulting bulk bin should be rugged enough to withstand abuse during the handling and moving of the bin from place to place on pallets, and must be of sufficient strength to insure that it will not break apart or split when being transported.

In U.S. Ser. No. 829,625, filed Sep. 1, 1977 and assigned to the same assignee as the present application, a new and improved paperboard bulk bin, which is preferably octagon-shaped and includes an upstanding side wall formed from first and second opposed pairs of side panels, and two pairs of corner panels, is disclosed. Each corner panel is disposed between one of the panels of each first and second pair of side panels, and foldably connected to each side and corner panel is a bottom flap portion. The four flaps extending from the corner panels are folded inwardly, preferably to an overlapped relationship. The flaps extending from the first pair of opposed side panels are substantially rectangular in configuration, while the flaps extending from the second pair of side panels are slotted, with the respective slots in said flaps being aligned to accept therebetween the flaps extending from the first pair of side panels. The interengagement of the flaps extending from the side panels, as well as the overlapping of the flaps from the corner panels provide a substantially more rigid bottom wall for the bulk bin, as contrasted e.g., with the bin construction illustrated in U.S. Pat. No. 3,945,558. In this patent, a bottom wall is press-fitted into the bin interior and under heavy loads can buckle causing the bin container to come apart.

SUMMARY OF THE INVENTION

The subject bulk bin is made as in U.S. Pat. No. 3,945,558 from a two-piece construction but includes a similar interengagement feature as in U.S. Ser. No. 829,625 wherein corner panels on the side walls of the bin have flaps received in locking engagement with a separate complementary shaped bottom sheet. When the bin is assembled, the corners of the bin meet the corners of the bottom sheet. Thus, the bin becomes rigid and will not buckle when turned upright. Because of the substantial enclosure of the entire bottom of the bin, the weight of the product is distributed over the entire area thereof in a more uniform manner than heretofore as the applied pressure of the product bears against an enclosed bottom. This results in a sturdier construction and one not subject to bursting of the bottom and collapse of the container. Furthermore, because of the two-piece construction described, once a corner flap is inserted in a slot in the bottom sheet, it locks the two pieces together wherein the bottom sheet can be used as a jig or guide for the assembly of the bin side walls.

BRIEF DESCRIPTION OF THE DRAWINGS

Further objects and advantages of the invention will become apparent from the following specification and claims, and from the accompanying drawings, wherein:

DETAILED DESCRIPTION OF THE PREFERRED EMBODIMENT

Figure 1:
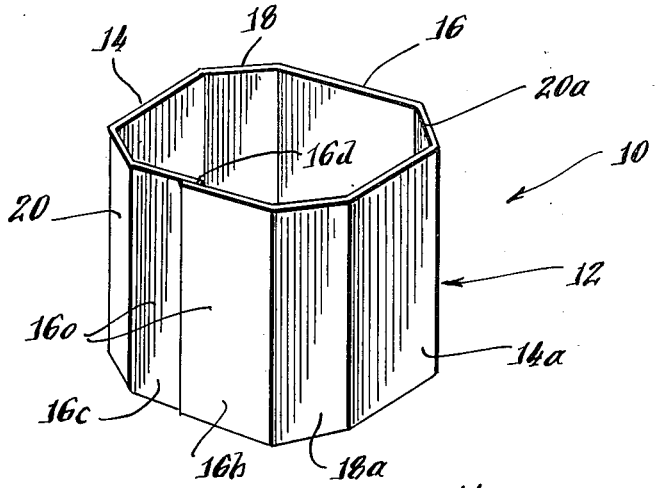
FIG. 1 is a top perspective view of the assembled bulk bin of the present invention.

Referring now to the drawing in detail, wherein like numerals indicate like elements throughout the several views, the bulk bin of the subject invention is designated by the numeral 10, and is preferably made of a paperboard material, such as single wall or double wall corrugated board.

The bulk bin is formed of a single blank 11 which is slotted and scored, and a die cut octagonal sheet 11*a*, as more fully described hereinafter. The bulk bin 10 includes an upstanding side wall 12 formed from blank 11 and a bottom wall 13, formed from sheet 11*a*. The upstanding side wall 12 is of generally octagon configuration and basically comprises a first pair of opposed side panels 14, 14*a*, a second pair or opposed side panels 16, 16*a*, a first pair of opposed corner panels 18, 18*a* and a second pair of opposed corner panels 20, 20*a*. Each side and corner panel is substantially rectangular in configuration, with the side panel 16*a* being formed by two side wall portions 16*c* and 16*b* which are bonded along seam 16*d*. Portions 16*c* and 16*b* are bonded by means of a suitable adhesive, or alternatively, may be stapled together in order to complete the upstanding side wall 12 of the bulk bin 10.

Figure 2:
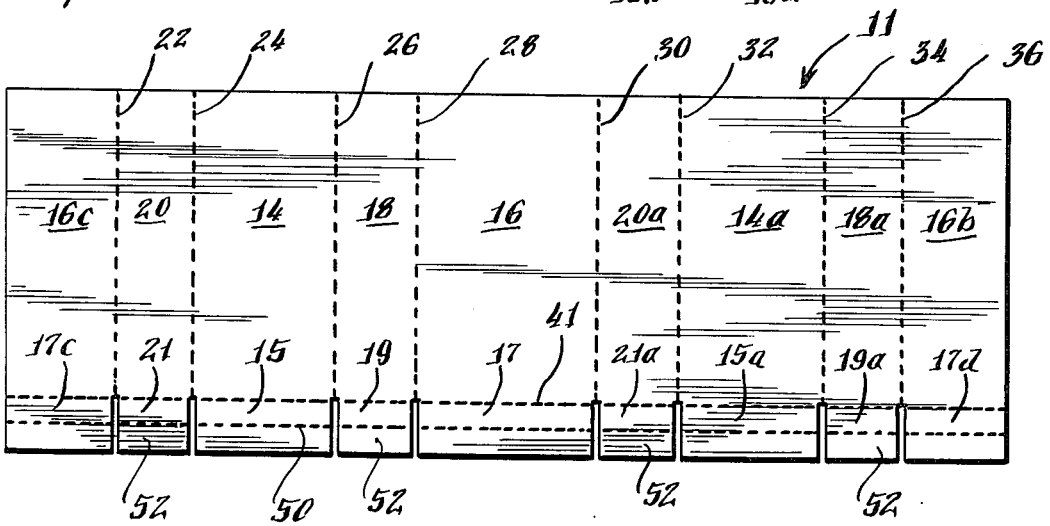
FIG. 2 is a plan view of a blank used to form the side wall of the bulk bin of FIG. 1.
Figure 3:
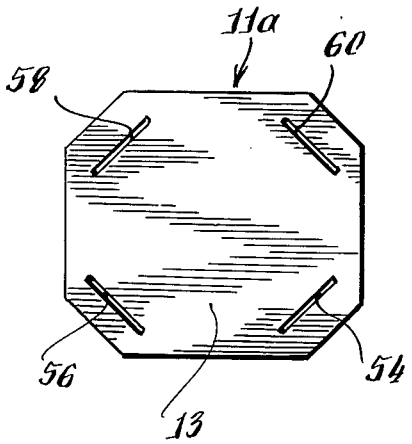
FIG. 3 is a plan view of a die cut sheet used to form the bottom of the bulk bin of FIG. 1.
Figure 4:
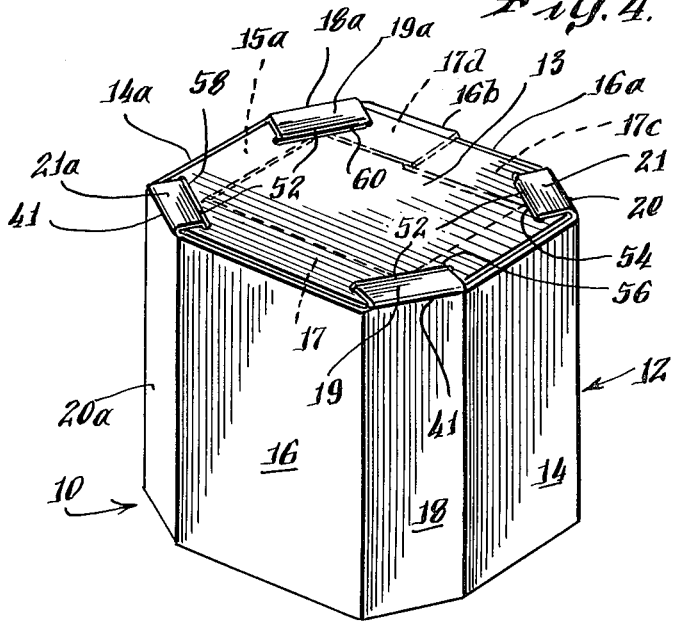
FIG. 4 is a bottom perspective view of the assembled bulk bin of FIG. 1.

As shown in FIG. 2, each corner panel is disposed between one of the side panels so that the side panels and corner panels are alternatively arranged. Furthermore, the respective side and corner panels are hingedly connected along hinge lines designated by the numerals 22 through 36 inclusive. Extending from each side panel and corner panel and hingedly connected along fold line 41 thereto is a flap. More particularly, as shown in FIG. 2, extending from the corner panels 18 and 18*a* are flaps 19 and 19*a*, respectively. Likewise, extending from the corner panels 20 and 20*a* are flaps 21 and 21*a*. Flaps 19, 19*a* and 21, 21*a* are generally rectangular in configuration, and in the erected condition of the bulk bin 10 are disposed generally horizontally.

Foldably connected to the lower edge of the first pair of opposed side panels 14 and 14*a* are rectangular flaps 15 and 15*a*. Foldably connected to the side panel 16 of the second pair of opposed side panels is a flap 17. In like manner, each side panel portion 16*c* and 16*b* includes a foldably connected bottom flap 17*c* and 17*d*, respectively. As also shown in FIG. 2, a single score line 50 extends across all of the flaps, closer to the free edge thereof.

In the erection of the subject bulk bin, the blank 11 is first folded about the fold lines 22 through 36, and side wall panels 16*c* and 16*b* are bonded along seem 16*d*, forming the octagonal side wall 12. Then, the flaps 15,

15*a*, 17 and 17*c*–17*d* are folded about the fold line 41 into horizontal planes; the flaps 17 and 17*c*–17*d* overlapping flaps 15, 15*a* and the interior of bin 10. The four flaps 21, 19, 21*a*, 19*a* extending from the corner panels are then folded inwardly about score line 41 and their free ends folded about score line 50. Die cut sheet 11*a* which is octagonal in plan and dimensioned to complement the interior dimensions of the bottom of bin 10 is inserted between flaps 21, 19, 21*a*, 19*a* and the horizontal flaps 17 and 17*c*–17*d*. The free ends 52 of flaps 21, 19, 21*a* and 19*a* are inserted through aligned apertures 54–60, respectively in die cut sheet 11*a* so as to lock the sheet 11*a* to the side wall 12 of the bulk bin 10 to form a completely closed bottom which is interlocked with the side wall 12.

Alternatively, one of the corner flaps 21, 19, 21*a* or 19*a* can be first inserted in an appropriate slot 54–60, and the sheet 11*a* used as a jig about which the side wall 12 of the bin 10 can be formed. Furthermore, where the weight of the product to be shipped allows the bins to be stacked on top of each other, similar flaps 15–21 can be added to the other end of the bin blank 11 to be connected to a second sheet 11*a* as a cover.

The subject invention, and many of its intended advantages will be understood from the foregoing description, and it will be apparent that various changes may be made in the form and construction of the subject bulk bin without departing from the spirit and scope of the invention as defined by the following claims.

What is claimed is:

1. An octagonal-shaped paperboard bulk bin comprising:

a side wall formed from opposed pairs of substantially rectangular, upstanding side panels and opposed pairs of substantially rectangular, upstanding corner panels that are alternatively, foldably connected, each corner panel including a horizontally disposed, substantially rectangular flap foldably connected to the bottom edge thereof, each side panel including a horizontally disposed, substantially rectangular flap foldably connected to the bottom edge thereof, and an octagonal planar sheet disposed between said opposed pairs of side panel flaps and corner panel flaps to form a bottom for said bin, said sheet including interior slots adjacent the corners thereof receiving a free end of each of said corner panel flaps therethrough to lock said side wall to said sheet.

2. An octagonal-shaped paperboard bulk bin as in claim 1 wherein said bin is formed from at least a single wall corrugated board.

3. An octagonal-shaped paperboard bulk bin as in claim 1 wherein the free end of each flap extending from said corner panels includes a fold line extending parallel to the foldable connection thereof to said corner panel.

4. An octagonal-shaped paperboard bulk bin as in claim 1 wherein one of said side panels is formed by two portions secured together.

5. An octagonal-shaped paperboard bulk bin as in claim 4 wherein said two portions are bonded together.

* * * * *